US009688043B2

(12) United States Patent
Lin

(10) Patent No.: US 9,688,043 B2
(45) Date of Patent: Jun. 27, 2017

(54) UNINTERRUPTED BAG MAKING MACHINE

(71) Applicant: COSMO MACHINERY CO., LTD., New Taipei (TW)

(72) Inventor: Chun Liang Lin, New Taipei (TW)

(73) Assignee: COSMO MACHINERY CO., LTD., New Taipei (TW)

( * ) Notice: Subject to any disclaimer, the term of this patent is extended or adjusted under 35 U.S.C. 154(b) by 497 days.

(21) Appl. No.: 14/267,062

(22) Filed: May 1, 2014

(65) Prior Publication Data

US 2015/0314549 A1 Nov. 5, 2015

(51) Int. Cl.
*B31B 23/00* (2006.01)
*B31B 19/00* (2006.01)

(52) U.S. Cl.
CPC ..... *B31B 19/00* (2013.01); *B31B 2219/94* (2013.01); *B31B 2219/95* (2013.01); *B31B 2237/60* (2013.01)

(58) Field of Classification Search
CPC ..... B31B 23/00; B31B 2237/60; B65B 43/04; B65B 43/123; B65B 61/02
USPC ..... 53/570; 493/194, 195, 196, 197, 198, 493/199, 200, 202, 203, 209
See application file for complete search history.

(56) References Cited

U.S. PATENT DOCUMENTS 3,735,673 A * 5/1973 Sheehan ..... B31B 23/00 264/209.3
4,214,509 A * 7/1980 Van der Meulen ..... B31B 19/64 156/253
4,250,796 A * 2/1981 Achelpohl ..... B29C 65/18 156/583.5
5,296,071 A * 3/1994 Tapp ..... B26D 7/14 156/257
5,426,918 A * 6/1995 Ball ..... A47F 9/043 53/389.2
5,724,789 A * 3/1998 Corella ..... B31B 23/00 53/450
5,993,368 A * 11/1999 Benovitz ..... B31B 1/74 493/196

(Continued)

FOREIGN PATENT DOCUMENTS

TW 189481 8/1992

*Primary Examiner* — Thanh Truong
*Assistant Examiner* — Thomas Wittenschlaeger
(74) *Attorney, Agent, or Firm* — Ming Chow; Sinorica, LLC

(57) ABSTRACT

An uninterrupted bag making machine includes a conveyance unit, a conveyance unit driving means, a sealing unit having sealing assemblies, a sealing unit driving means, a perforating unit having a cutting device, a perforating unit, a perforating unit driving means, a breaking unit, and a control unit. With the conveyance unit, a film tube is conveyed to pass through the sealing unit, the perforating unit, and the breaking unit. Furthermore, with the control unit in cooperation with various driving means, the sealing assemblies can be moved in the direction of the film tube being moved, and the cutting device of the perforating unit is rotated in synchronous with the film tube being moved. As such, the film tube can be processed with sealing operations, perforating operations, and breaking operations at predetermined locations along the film tube without an interruption, so that the production rate and capacity can be increased.

17 Claims, 6 Drawing Sheets

(56) References Cited

U.S. PATENT DOCUMENTS

| | | | | |
|---|---|---|---|---|
| 6,247,293 | B1 * | 6/2001 | Todd | B29C 66/43121 53/329.2 |
| 2003/0230052 | A1 * | 12/2003 | Rabiea | B31B 19/90 53/459 |
| 2009/0045035 | A1 * | 2/2009 | Helgerson | B65G 13/07 198/781.01 |
| 2009/0261139 | A1 * | 10/2009 | Reggiani | B65B 69/00 225/1 |

* cited by examiner

UNINTERRUPTED BAG MAKING MACHINE

TECHNICAL FIELD OF THE INVENTION

The present invention relates to a bag making machine and, more particularly, to an uninterrupted bag making machine.

DESCRIPTION OF THE PRIOR ART

Currently, the existing plastic bags, such as vest bags, are widely used in shopping. In manufacturing the plastic bags, a film tube is firstly formed by a blown film extruder, and then sealed and cut by a machine to form bags, which are then stacked and fed into a punching machine to form openings for the handles of bags. Among the existing technology, there is a machine being dedicated for making vest bags into a roll form, as disclosed in Taiwan's utility model patent 189481, which employs an upper mold and a lower mold to perform a slitting operation, a perforating operation, and a sealing operation simultaneously to form an individual bag at a location of a film tube, which is finally assembled into a roll form for allowing a user to take an individual bag more easily and allowing the product to be stored more easily.

However, in manufacturing plastic bags, conventional machines should stop the film tube from being conveyed for a short while to conduct the slitting, perforating, sealing operations, or other required operations, and thus the production rate and capacity will be comprised. Besides, the interruption for stopping conveying the film tube may cause additional abrasion of mechanic elements of the machine and increase its load. As a result, the life span of the machine may be reduced.

Since plastic bags are widely used in daily life and the price per unit of plastic bags is low, for a commercial production, they should be processed in a more efficient way.

Currently, there is no technique to solve the above drawbacks of conventional bag making machines. Therefore, it is deserved for a technician to take time on improving them.

SUMMARY OF THE INVENTION

The object of the present invention is to provide an uninterrupted bag making machine that can conduct sealing operations, perforating operations, and breaking operations for film tubes without an interruption.

The advantages of the present invention is that the uninterrupted bag making machine can produce handheld plastic bags, which are widely used in shopping, without an interruption, so that the production rate and capacity can be increased.

To achieve the above object, the uninterrupted bag making machine may include a conveyance unit, a conveyance unit driving means, a sealing unit, a sealing unit driving means, a perforating unit, a perforating unit driving means, and a breaking unit. The conveyance unit conveys a film tube supplied from a material source to various processing units. The conveyance unit driving means provides the mechanical power for the conveyance unit to convey the film tube. The sealing unit includes an upper sealing assembly being arranged above the film tube, a lower sealing assembly being arranged below the film tube and aligned with the upper sealing assembly with respect to the film tube, and a transmission means for driving the upper sealing assembly and the lower sealing assembly to move parallel to the film tube and in the direction of the film tube being moved, so that a sealing operation for the film tube can be conducted. The sealing unit driving means provide the mechanical power for the transmission means of the sealing unit to move the upper and lower sealing assemblies. The perforating unit is arranged downstream of the sealing unit and has a cutting device being provided with a perforation pattern at its circumference for making tiny perforations on the film tube. The perforating unit driving means provides the mechanical power for driving the perforating unit to make tiny perforations on the film tube so as to form a perforated portion thereon. The breaking unit, being arranged downstream of the perforating unit, includes a device for breaking the perforated portion of the film tube made by the perforating unit off the rest of the film tube.

With a control unit being electrically connected with the conveyance unit driving means, the sealing unit driving means, the perforating unit driving means, and associated components, various operations of making bags can be controlled. Specifically, the upper sealing assembly and the lower sealing assembly are controlled such that, while a sealing operation for the film tube is conducted, the sealing assemblies are simultaneously moved, in the direction of the film tube being moved, at a speed the same as the film tube being moved. The cutting device of the perforating unit is rotated in synchronous with the film tube being moved. Also, the breaking unit may further include two mutually meshed rollers being arranged below the breaking device and the film tube, so that the perforated portion being broken by the breaking device can be taken by the meshed rollers and discharged through the meshed rollers.

Specifically, the breaking device of the breaking unit can be an air nozzle being arranged above the film tube and the two mutually meshed rollers to produce an air jet to the perforated portion so that it can be blown off the rest of the film tube.

Specifically, the transmission means includes an upper transmission mechanism being arranged above the film tube and a lower mechanism being arranged below the film tube and aligned with the upper transmission mechanism. The upper transmission mechanism includes an upper guiding rail whereas the lower transmission mechanism includes a lower guiding rail. The upper and lower guiding rails can help the upper and lower sealing assemblies move in the direction of the film tube being moved to facilitate a sealing operation.

With the aid of the conveyance unit and the associated driving means, a film tube can be conveyed to pass through the sealing unit, the perforating unit, and the breaking unit. Furthermore, with the aid of the sealing unit driving means, the upper and lower sealing assemblies can be moved in the direction of the film tube being moved; with the aid of the perforating unit driving means, the cutting device of the perforating unit is rotated at an arc length equal to the distance of a path along which the film tube is moved per time unit, so that the cutting device is rotated in synchronous with the film tube being moved. Therefore, the film tube can be processed with sealing operations, perforating operations, and breaking operations at predetermined locations along the film tube without an interruption, so that the production rate and capacity can be increased.

Alternatively, the breaking device of the breaking unit can be a robotic arm or other servomechanisms that can break the perforated portion through vertically or horizontally reciprocating movement.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
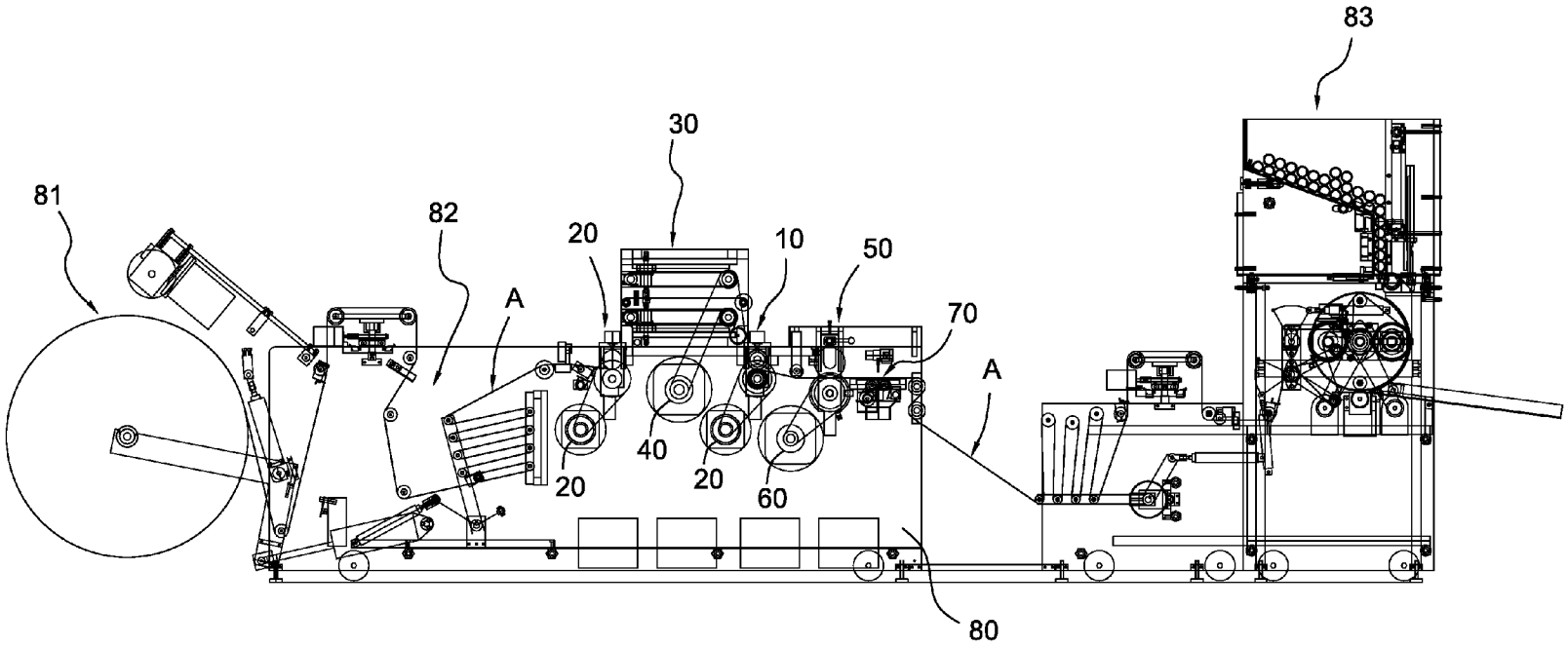
FIG. 1 shows a schematic side view of one embodiment of the present invention which is incorporated with a material stocking unit and a product stocking unit respectively upstream and downstream of the embodiment.

Referring to FIGS. 1 through 4, an uninterrupted bag making machine according to one embodiment of the present invention is disclosed, which generally comprises a conveyance unit 10, a conveyance unit driving means 20, a sealing unit 30, a sealing unit driving means 40, a perforating unit 50, a perforating unit driving means 60, a breaking unit 70, and a control unit (not shown). The conveyance unit 10, for example, may include a pair of nip rollers 11 for conveying a film tube (A) supplied from a material source to various processing units. The conveyance unit driving means 20 is provided for driving the nip rollers 11 of the conveyance unit 10 to rotate and thus convey the film tube (A). The sealing unit 30 includes an upper sealing assembly 32 being arranged above the film tube (A), a lower sealing assembly 33 being arranged below the film tube (A) and aligned with the upper sealing assembly 32 with respect to the film tube (A), and a transmission means 31 for driving the upper assembly 32 and the lower assembly 33 to move parallel to the film tube (A) and in the direction of the film tube (A) being moved. The sealing unit driving means 40 is provided for driving the transmission means 31 of the sealing unit 30 to move the upper and lower sealing assemblies 32, 33. The perforating unit 50 is arranged downstream of the sealing unit 30 and has a cutting device, which may include a pair of cutting rollers 51, being provided with a perforation pattern at its circumference for making tiny perforation on the film tube (A). The perforating unit driving means 60 is provided for driving the perforating unit 50 to make tiny perforations on the film tube (A) so as to form a perforated portion (A1) thereon. The breaking unit 70 is arranged downstream of the perforating unit 50 for breaking the perforated portion (A1) of the film tube (A) made by the breaking unit 50 off the rest of the film tube (A). The breaking unit 70 includes a device 71 for breaking the perforated portion (A1) of the film tube (A) made by the perforating unit 50. The breaking unit 50 will be further illustrated in the following paragraphs.

The control unit (not shown) is electrically connected with the conveyance unit driving means 20, the sealing unit driving means 40, the perforating unit driving means 60, and associated components, such as sensors or pneumatic control valves, for controlling various operations of making bags. Specifically, the upper sealing assembly 32 and the lower sealing assembly 33 are controlled such that, while a sealing operation for the film tube (A) is conducted, the sealing assemblies 32, 33 are simultaneously moved, in the direction of the film tube (A) being moved, at a speed the same as the film tube (A) being moved. In other words, the upper and lower sealing assemblies 32, 33 are moved in synchronous with the film tube (A) being moved. Furthermore, the cutting rollers 51 of the cutting device of the perforating unit 50 are controlled such that they are rotated at an arc length equal to the distance of a path along which the film tube (A) is moved per time unit. In other words, the cutting rollers 51 are rotated in synchronous with the film tube (A) being moved.

As shown, the breaking unit 70 may further include two mutually meshed rollers 72 being arranged below the breaking device 71 and the film tube (A), so that the perforated portion (A1) being broken by the device 71 can be taken by the meshed rollers 72 and discharged through the meshed rollers 72.

With the aid of the conveyance unit 10, the film tube (A) can be conveyed to pass through the sealing unit 30, the perforating unit 50, and the breaking unit 70 sequentially. The sealing unit driving means 40 allows the upper sealing assembly 32 and the lower sealing assembly 33 to be simultaneously moved in the direction of the film tube (A) being moved. During a sealing operation, the assemblies 32, 33 are moved at a speed the same as the film tube (A) being moved. The breaking device 71 of the breaking unit 70 can break the perforated portion (A1) of the film tube (A) made by the perforating unit 50 off the rest of the film tube film (A). The perforating unit driving means 60 allows the cutting rollers 51 of the cutting device of the perforating unit 50 to be rotated at an arc length equal to the distance of a path along which the film tube (A) is moved per time unit. The film tube (A) is continuously conveyed to various units of the machine to conduct sealing operations, perforating operations, and breaking operations at predetermined locations of the film tube (A) without an interruption, so that the production rate and capacity can be increased, the details of which will be fully described in the following paragraphs.

Preferably, a machine frame 80 can be used to accommodate the conveyance unit 10, the conveyance unit driving means 20, the sealing unit 30, the sealing unit driving means 40, the perforating unit 50, the perforating unit driving means 60, and the breaking unit 70. The sealing unit 30, the perforating unit 50, and the breaking unit 70 can be arranged in order, such that the film tube (A) is conveyed to sequentially pass through the sealing unit 30, the perforating unit 50, and the breaking unit 70 to conduction sealing operations, perforating operations, and breaking operations.

In addition, a material stocking unit 81, a material supplying unit 82, and a product stocking unit 83 can be incorporated into the present invention. The material stocking unit 81 is used for stocking unprocessed film tubes (A). The material supplying unit 82 is used for drawing a film tube (A) out of the material stocking unit 81 and being cooperated with the conveyance unit 10 inside the machine frame 80, so that the film tube (A) can be conveyed to the sealing unit 30 inside the machine frame 80 more smoothly. The product stocking unit 83 is arranged downstream of the breaking unit 70 inside the machine frame 80 for assembling the film tube (A) of being processed by the breaking unit 70 into a packaged bag product, for example, in the form of a roll. Furthermore, the product stocking unit 83 can be used to cooperate with the material supplying unit 82 and the conveyance unit 10 inside the machine frame 80 to allow the film tube (A) to pass through the sealing unit 30, the perforating unit 50, and the breaking unit 70 more smoothly.

Figure 2:
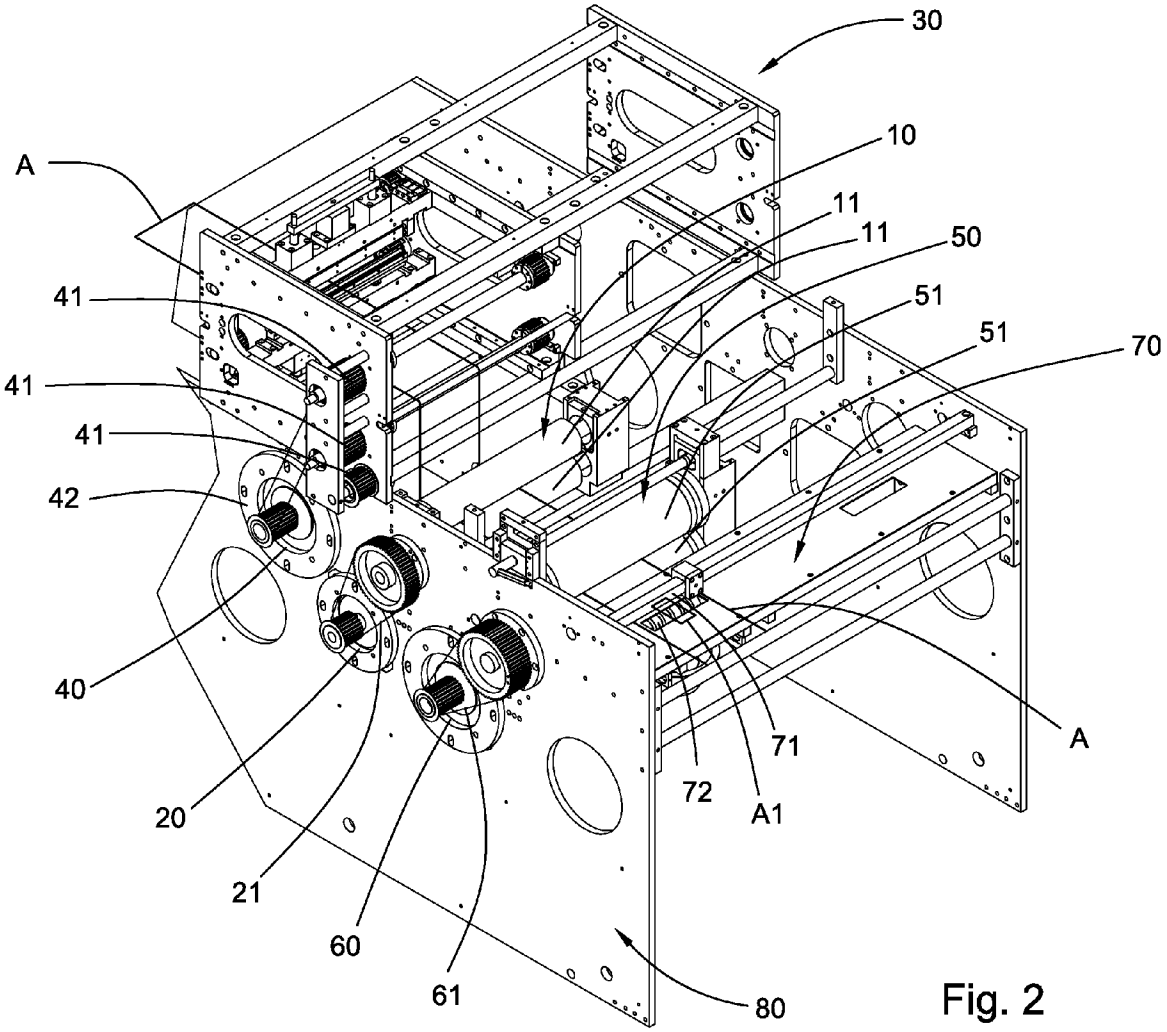
FIG. 2 shows a 3-dimensional view of the embodiment of the present invention.
Figure 3:
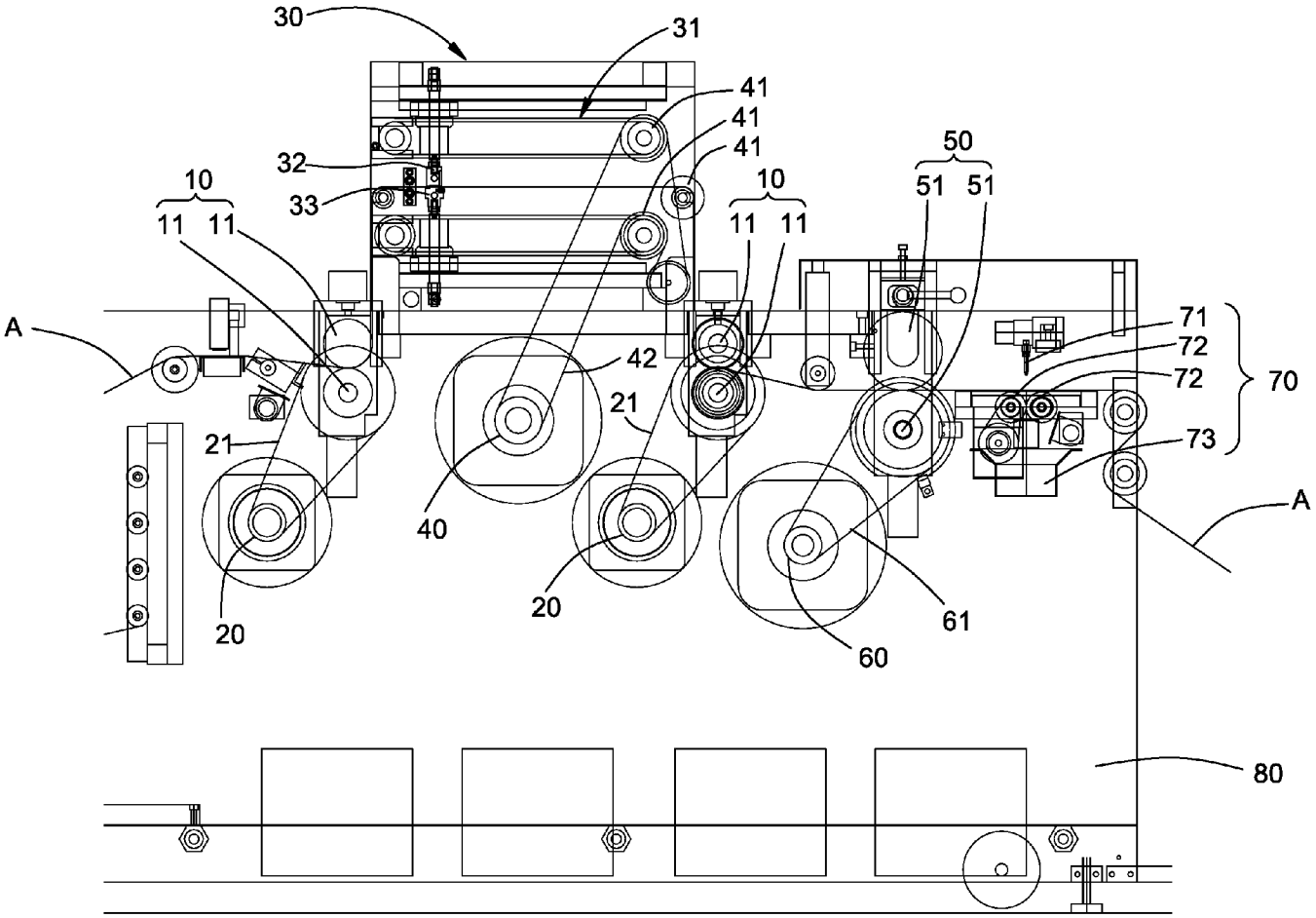
FIG. 3 shows a side view of the embodiment of the present invention.

In this embodiment, as shown in FIGS. 2 and 3, the conveyance unit 10 may include a pair of nip rollers 11 being arranged vertically, allowing the film tube (A) to have a friction contact with the rollers 11. Thus, when the rollers 11 rotate, the film tube (A) is moved forwardly. Moreover, for ease of conveying the film tube (A), two conveyance units can be respectively located upstream and downstream of the sealing unit 30.

Specifically, the conveyance unit driving means 20 can be a motor, such as a servomotor or a stepper motor. Generally, a belt 21 can be used with the motor to drive the nip rollers 11 to rotate. The belt 21 can be a toothed belt for non-slippage and less noise operation.

Figure 4:
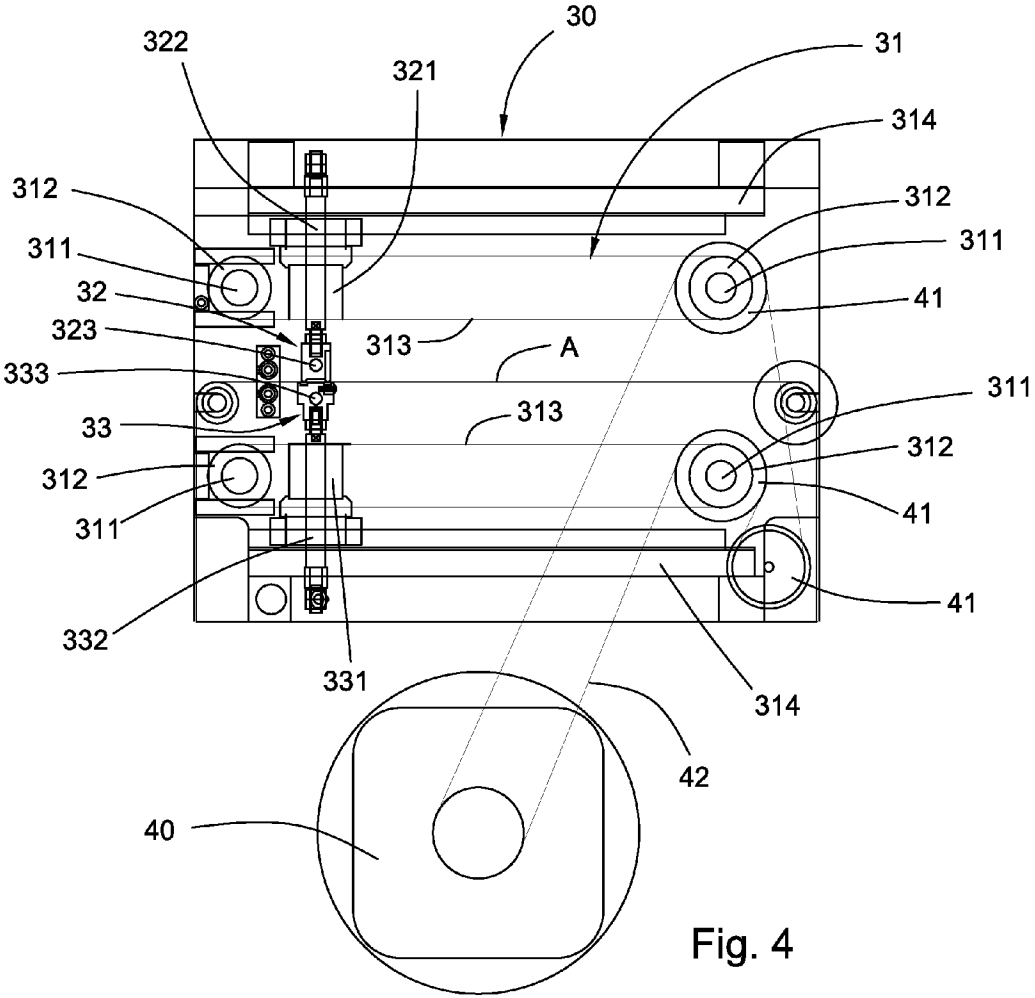
FIG. 4 shows a side view of a sealing unit and the associated driving means of the embodiment of the present invention.
Figure 5:
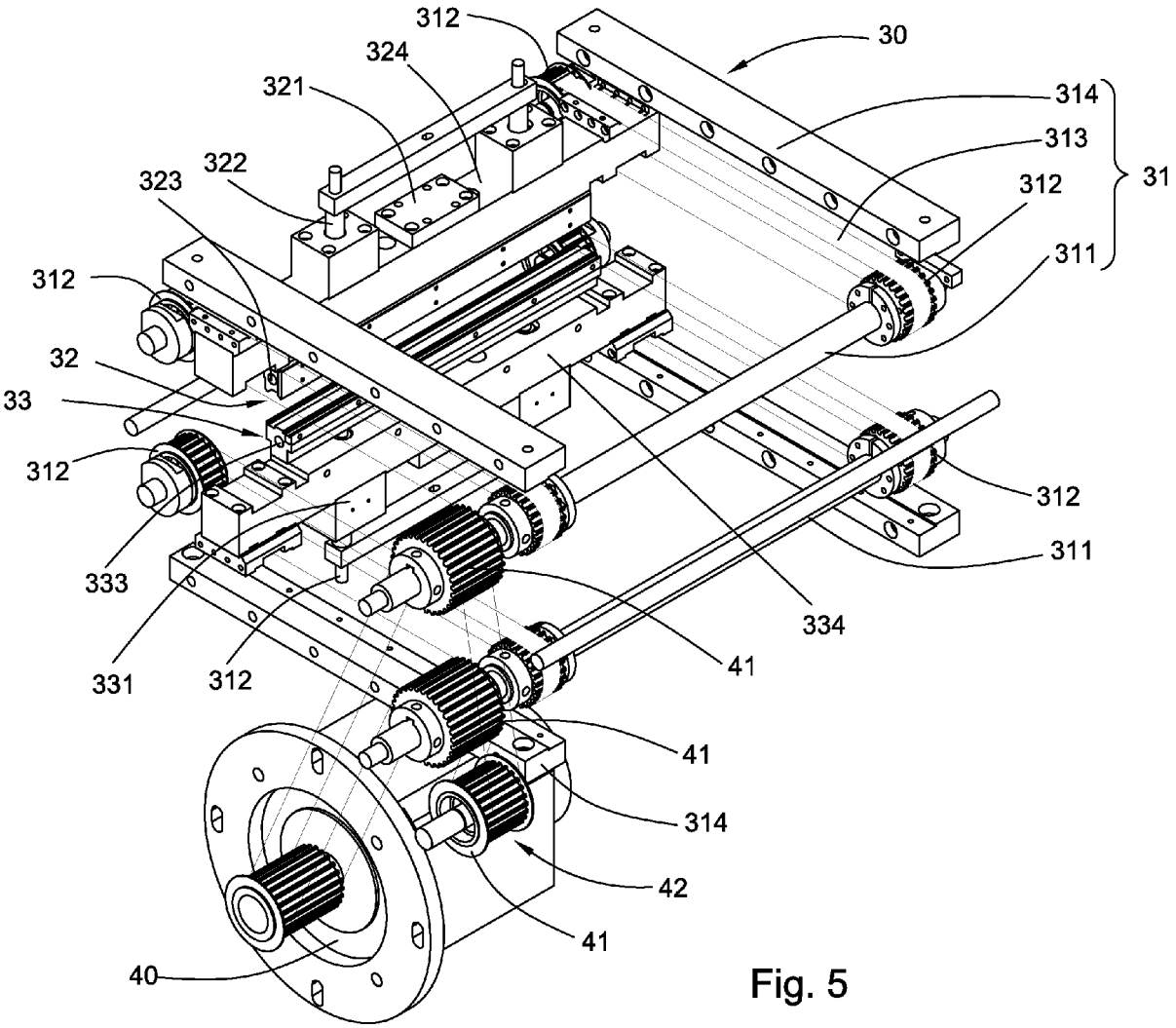
FIG. 5 shows a 3-dimensional view of the sealing unit and the associated driving means of the embodiment of the present invention, wherein the sealing assemblies are at their original positions

In this embodiment, as shown in FIGS. 4 and 5, the transmission means 31 of the sealing unit 30 may include an upper transmission mechanism being arranged above the film tube (A) and a lower mechanism being arranged below the film tube (A) and aligned with the upper transmission mechanism. The upper transmission mechanism includes two upper axles 311, two sets of upper wheels 312 each mounted at two ends of one of the upper axles 311, two upper belts 313 being looped around the upper wheels 312 to have the upper axles 311 coupled together and being parallel to the moving direction of the film tube (A), and an upper guiding rail 314 arranged above the upper belts 313. The lower transmission mechanism includes two lower axles 311, two sets of lower wheels 312 each mounted at two ends of one of the lower axles 311, two lower belts 313 being looped around the lower wheels 312 to have the lower axles 311 coupled together and being parallel to the moving direction of the film tube (A), and a lower guiding rail 314 arranged below the lower belts 313. The upper sealing assembly 32 is fixed to the upper belts 313 of the upper transmission assembly and movably coupled to the upper guiding rail 314 whereas the lower sealing assembly 33 is fixed to the lower belts 313 of the lower transmission mechanism and movably coupled to the lower guiding rail 314. As such, the upper sealing assembly 32 can be driven to move parallel to the film tube (A) by the upper belts 313, whereas the lower sealing assembly 33 can be driven to move parallel to the film tube (A) by the lower belts 313. The upper guiding rail 314 can help the upper sealing assembly 32 move together with the upper belts 313 whereas the lower guiding rail 314 can help the lower sealing assembly 33 move together with the lower belts 313.

The upper sealing assembly 32 includes an upper supportive block 324, an upper cylinder block 321 fixed to the upper supportive block 324, an upper pneumatic rod 322 driven by the upper cylinder block 321, and an upper sealing blade attached to the end of the upper pneumatic rod 322. The lower sealing assembly 33 includes a lower supportive block 334, a lower cylinder block 331 fixed to the lower supportive block 334, a lower pneumatic rod 332 driven by the lower cylinder block 331, and a lower sealing blade attached to the end of the lower pneumatic rod 332. The upper supportive block 324 is fixed to the upper belts 313 and movably connected to the upper guiding rail 314 whereas the lower supportive block 334 is fixed to the lower belts 313 and movably connected to the lower guiding rail 324, such that the upper sealing assembly 32 can be driven to move parallel to the film tube (A) by the upper belts 313 and the lower sealing assembly 33 can be driven to move parallel to the film tube (A) by the lower belts 313. Furthermore, the upper sealing assembly 32 is provided with a heater 323 at the upper sealing blade thereof. The lower sealing assembly 33 is provided with a heater 333 at the lower sealing blade thereof. The heaters 323, 333, which can produce the heat required for sealing the film tube (A), can be a heating pipe, a heating bar, or a resistance heating element. During an sealing operation, the upper sealing blade of the upper sealing assembly 32 and the lower sealing blade of the lower sealing assembly 33 can be simultaneously moved towards the film tube (A), in a direction perpendicular to the film tube (A) being moved, through the corresponding pneumatic rods 322, 332 so as to seal the film tube (A) in addition to the sealing assemblies 32, 33 being moved in the direction of the film tube (A) being moved.

Specifically, the sealing unit driving means 40 can be a motor, such as a servomotor or a stepper motor. The motor can rotate in two different directions. Also, a number of additional wheels 41 can be provided between the transmission means 31 and the motor 40, wherein some of the additional wheels 41 are provided at the axles 311 of the upper and lower transmission mechanisms of the transmission means 31 and the motor 40, and a belt 42 is looped around the additional wheels 41, so that the motor 40 is capable of driving the axles 311 of the upper and lower transmission mechanisms of the transmission means 31 to rotate in two different directions, which in turn drives the upper and lower sealing assemblies 32, 33 to move in a direction parallel to the film tube (A) being moved. While the upper and lower sealing assemblies 32, 33 are moved forwardly, the sealing assemblies 32, 33 are moved at a speed the same as the film tube (A) being moved, so that the film tube (A) can be sealed while it is being moved; in other words, the sealing assemblies 32, 33 are moved in synchronous with the film tube (A) being moved to complete a sealing operation for the film tube (A)(see FIG. 6). Upon the sealing operation is completed, the pneumatic rods 322, 332 can be retracted by the corresponding cylinder blocks 321, 331 and the motor 40 will rotate in the opposite direction to have the upper and lower belts 313 moved in a reverse direction, such that the sealing assemblies 32, 33 can be driven by the corresponding belts 313 to move backwardly and thus return to their original positions for a next sealing operation (see FIG. 5). Specifically, the belt 42 can be a toothed belt whereas the additional wheels 41 can be a toothed wheel or sprocket for non-slippage and less noise operation.

Referring again to FIGS. 2 and 3, the cutting device of the perforating unit 50 includes a pair of cutting rollers 51 being arranged vertically and provided with the peroration pattern for making tiny perforations on the film tube (A) that passes between the cutting rollers 51.

Specifically, the perforating unit driving means 60 can be a motor, such as a servomotor or a stepper motor. A belt 61 can be used to connected between the motor 60 and the cutting rollers 51 so as to rotate the cutting rollers 51 and thus perforate the film tube (A) passing therebetween. The belt 61 can be a toothed belt for non-slippage and less noise operation.

In this embodiment, the device 71 for breaking the perforated portion (A1) of the film tube (A) in the breaking unit 70 can be an air nozzle being arranged above the film tube (A) and the two mutually meshed rollers 72. Furthermore, the breaking unit 70 may include a waste collector 73 placed below the two meshed rollers 72. The nozzle 71 can produce an air to the perforated portion (A1) made by the perforating unit 50 to blow it off the rest of the film tube (A), and the perforated portion (A1) being blown off can be taken by the two meshed rollers 72 and discharged therethrough to enter the waste collector 73.

Figure 6:
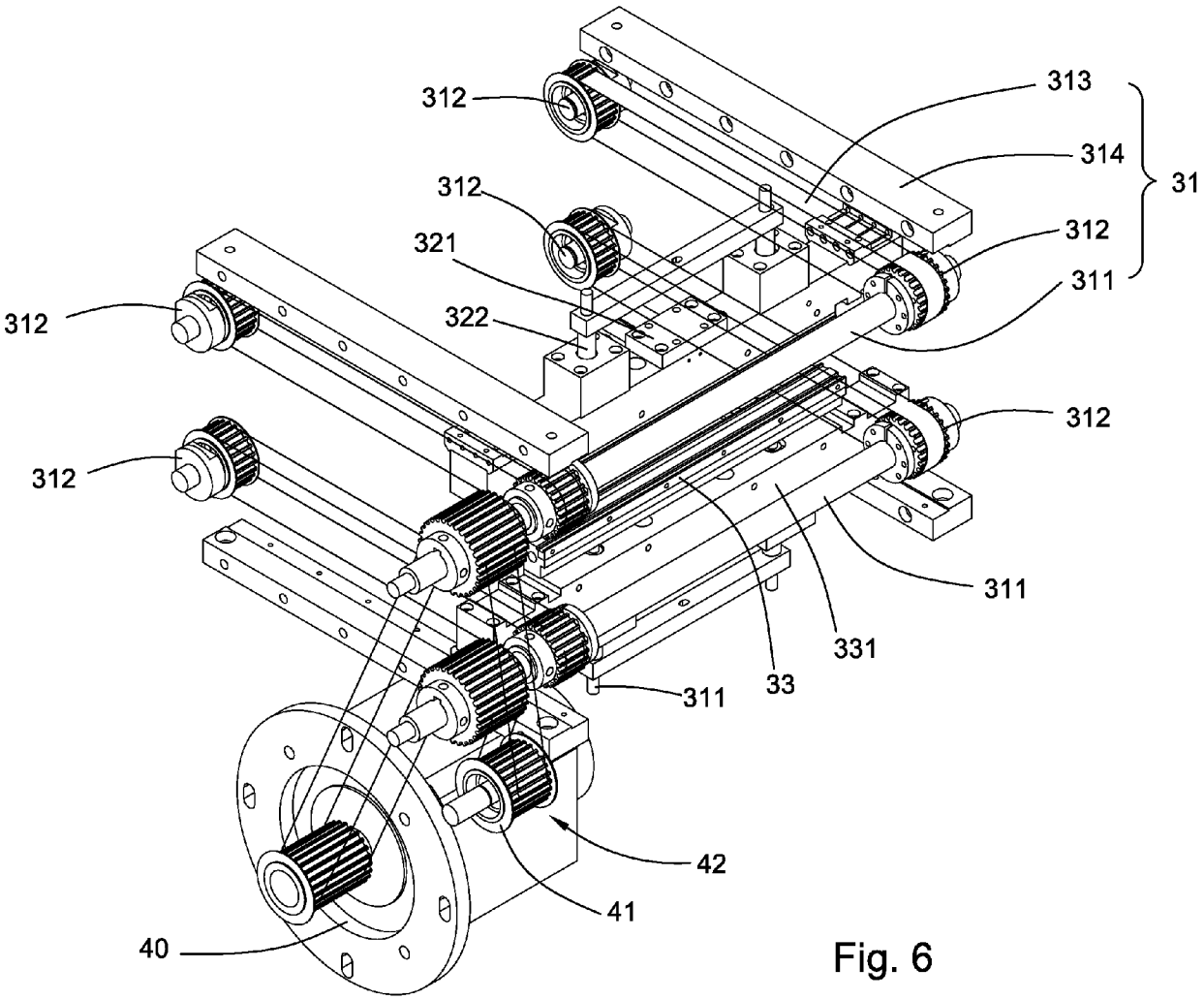
FIG. 6 shows a 3-dimensional view of the sealing unit and the associated driving means of the embodiment of the present invention, wherein the sealing assemblies are moved forwardly to positions where a sealing operation is conducted.

FIGS. 4, 5 and 6 show more details of the sealing unit 30 of the present invention. In a sealing operation, while the film tube (A) is conveyed to go through the upper sealing assembly 32 and the lower sealing assembly 33 of the sealing unit 30, the motor 40 can drive the belt 42 to rotate the axles 311 in a direction and thus drive the sealing assemblies 32, 33 to move forwardly in the moving direction of the film tube (A) at the same speed. When the upper and lower sealing assembly 32, 33 are moved to a predetermined position, the upper and lower cylinder blocks 321, 331 can be activated to drive the corresponding pneumatic rods 322, 332 to move towards the film tube (A), in a direction perpendicular to the moving direction of the film tube (A), to seal the film tube (A). Therefore, there is no need to stop the film tube (A) from being conveyed for a short while for conducting a sealing operation.

Furthermore, upon the sealing operation is completed, the upper and lower cylinder blocks 321, 331 can be activated to retract the corresponding pneumatic rods 322, 332 while the motor 40 can be controlled to rotate in the opposite direction so that the upper and lower sealing assemblies 32, 33 can be moved in a reverse direction opposite to the moving direction of the film tube (A), so that the sealing assemblies 32, 33 can return to their original positions for a next sealing operation.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. An uninterrupted bag making machine, comprising:

a conveyance unit for conveying a film tube supplied from a material source to various processing units;

a conveyance unit driving device for driving the conveyance unit to convey the film tube;

a sealing unit including an upper sealing assembly being arranged above the film tube, a lower sealing assembly being arranged below the film tube and aligned with the upper sealing assembly with respect to the film tube, and a transmission device for driving the upper assembly and the lower assembly to move parallel to the film tube and in the direction of the film tube being moved, so as to conduct a sealing operation for the film tube;

a sealing unit driving device for driving the transmission device of the sealing unit to move the upper and lower sealing assemblies;

a perforating unit being arranged downstream of the sealing unit and having a cutting device being provided with a perforation pattern at its circumference for making perforations on the film tube;

a perforating unit driving device for driving the perforating unit to make perforations on the film tube so as to form a perforated portion thereon;

a breaking unit being arranged downstream of the perforating unit, the breaking unit including a device for breaking the cut off perforated portions of the film tube made by the perforating unit and cut by the cutting device off the rest of the film tube by physically moving the cut off perforated portions away from the film tube;

a control unit being electrically connected with the conveyance unit driving device, the sealing unit driving device, the perforating unit driving device, and associated components for controlling various operations of making bags, wherein the upper sealing assembly and the lower sealing assembly are controlled such that, while a sealing operation for the film tube is conducted, the sealing assemblies are simultaneously moved in the direction of the film tube being moved at a speed the same as the film tube being moved;

wherein the sealing unit driving device is a motor;

the transmission device includes an upper transmission mechanism being arranged above the film tube and a lower mechanism being arranged below the film tube and aligned with the upper transmission mechanism, wherein the upper transmission mechanism includes two upper axles, two sets of upper wheels each mounted at two ends of one of the upper axles, two upper belts being looped around the upper wheels to have the upper axles coupled together and being parallel to the film tube, and an upper guiding rail arranged above the upper belts; the lower transmission mechanism includes two lower axles, two sets of lower wheels each mounted at two ends of one of the lower axles, two lower belts being looped around the lower wheels to have the lower axles coupled together and being parallel to the film tube, and a lower guiding rail arranged below the lower belts; wherein the upper sealing assembly is fixed to the upper belts of the upper transmission assembly and movably coupled to the upper guiding rail whereas the lower sealing assembly is fixed to the lower belts of the lower transmission mechanism and movably coupled to the lower guiding rail; and wherein the upper sealing assembly includes an upper supportive block, an upper cylinder block fixed to the upper supportive support, an upper pneumatic rod driven by the upper cylinder block, and an upper sealing blade attached to the end of the upper pneumatic rod, the lower sealing assembly includes a lower supportive block, a lower cylinder block fixed to the lower supportive block, a lower pneumatic rod driven by the lower cylinder block, and a lower sealing blade attached to the end of the lower pneumatic rod, the upper supportive block is fixed to the upper belts and movably connected to the upper guiding rail whereas the lower supportive block is fixed to the lower belts and movably connected to the lower guiding rail such that the upper sealing assembly is driven by the upper belts to move parallel to the film tube, and the lower sealing assembly is driven by the lower belts to move parallel to the film tube, whereby, during a sealing operation, the upper sealing blade and the lower sealing blade are simultaneously moved towards the film tube, in a direction perpendicular to the film tube, through the corresponding pneumatic rods to seal the film tube in addition to the sealing assemblies being moved in the direction of the film tube being moved.

2. The uninterrupted bag making machine of claim 1, wherein the cutting device is a rotating device being provided with the perforation pattern at its circumference, the cutting device being rotated at an arc length equal to the distance of a path along which the film tube is moved per time unit.

3. The uninterrupted bag making machine of claim 1, wherein the breaking unit further includes two mutually meshed rollers being arranged below the breaking device and the film tube, so that the perforated portion being broken by the breaking device will be taken by the meshed rollers and discharged through the meshed rollers.

4. The uninterrupted bag making machine of claim 3, wherein the breaking device of the breaking unit is an air nozzle being arranged above the film tube and the two mutually meshed rollers to produce an air jet to the perforated portion so as to blow it off the rest of the film tube.

5. The uninterrupted bag making machine of claim 1, wherein the conveyance unit includes a pair of nip rollers.

6. The uninterrupted bag making machine of claim 5, wherein the conveyance unit driving device is a motor.

7. The uninterrupted bag making machine of claim 6, wherein the nip rollers are driven by the motor through a belt to convey the film tube.

8. The uninterrupted bag making machine of claim 7, wherein the belt is a toothed belt.

9. The uninterrupted bag making machine of claim 1, wherein the sealing unit driving device is a servomotor or a stepper motor.

10. The uninterrupted bag making machine of claim 1, wherein upon the sealing operation is completed, the upper and lower pneumatic rods of the sealing assemblies will be moved away from the film tube while the sealing assemblies will be moved backwardly by the corresponding belts to return to their original positions for a next sealing operation.

11. The uninterrupted bag making machine of claim 1, wherein a number of additional wheels are provided at the axles of the upper and lower transmission mechanisms and the motor, and a belt is looped around the additional wheels so that the motor is capable of driving the axles of the upper and lower transmission mechanisms to move the upper and lower sealing assemblies.

12. The uninterrupted bag making machine of claim 11, wherein the belt is a toothed belt, and the additional wheels of the upper and lower transmission mechanisms and the motor are a toothed wheel.

13. The uninterrupted bag making machine of claim 1, wherein the cutting device of the perforating unit includes a pair of cutting rollers being provided with the perforation pattern, and the film tube is conveyed to pass between the cutting rollers.

14. The uninterrupted bag making machine of claim 13, wherein the perforating unit driving device is a motor.

15. The uninterrupted bag making machine of claim 14, wherein the perforating unit driving device is a servomotor or a stepper motor.

16. The uninterrupted bag making machine of claim 15, wherein a belt is a toothed belt.

17. The uninterrupted bag making machine of claim 14, wherein the cutting rollers of the perforating unit are driven by the perforating unit driving device through a belt to make perforations on the film tube.

* * * * *